US005842352A

United States Patent [19]

Gregory

[11] Patent Number: 5,842,352

[45] Date of Patent: Dec. 1, 1998

[54] REFRIGERATION SYSTEM WITH IMPROVED LIQUID SUB-COOLING

[75] Inventor: Charles Gregory, Burlington, Canada

[73] Assignee: Super S.E.E.R. Systems Inc., Burlington, Canada

[21] Appl. No.: 898,857

[22] Filed: Jul. 25, 1997

[51] Int. Cl.[6] ..... F25B 47/02

[52] U.S. Cl. ..... 62/151; 62/196.4; 62/278; 62/513

[58] Field of Search ..... 62/151, 81, 113, 62/513, 277, 278, 196.4, 80

[56] References Cited

U.S. PATENT DOCUMENTS

| | | | |
|---|---|---|---|
| 4,802,339 | 2/1989 | Gregory | 62/196.4 |
| 4,949,551 | 8/1990 | Gregory | 62/278 X |
| 4,979,371 | 12/1990 | Larson | 62/81 |
| 5,050,400 | 9/1991 | Lammert | 62/278 |

*Primary Examiner*—Harry B. Tanner
*Attorney, Agent, or Firm*—Rogers & Scott

[57] ABSTRACT

A refrigeration system has a compressor operable to supply relatively hot compressed refrigerant gas, a condenser to liquify the relatively hot compressed refrigerant gas from the compressor, a thermostatic expansion (TX) valve to vaporize liquified refrigerant from the condenser, an evaporator to cool the surrounding atmosphere by vaporized refrigerant from the TX valve, a superheat sensor to improve control of the TX valve, a compressor discharge line to convey relatively hot compressed refrigerant gas from the compressor to the condenser, a liquid line to convey liquified refrigerant from the condenser to the TX valve, and a suction line including the superheat sensor to convey vaporized refrigerant from the evaporator to the compressor. A liquid refrigerant stabilizer in the liquid line and the suction line is operable to convey liquid refrigerant in the liquid line and vaporized refrigerant in the suction line in heat exchange relationship with each other to cause liquid refrigerant in the liquid line to be cooled by suction refrigerant in the suction line. A de-frost valve assembly is operable to effect de-frosting by shutting off flow of liquid refrigerant from the condenser and substituting a flow of relatively hot compressed refrigerant gas from the compressor to cause the relatively hot compressed refrigerant gas to flow in the liquid line through the stabilizer to the TX valve and the evaporator to defrost the evaporator and return through the suction line through the stabilizer to the compressor. The stabilizer functions as a vaporizer during a de-frost cycle with the relatively hot compressed refrigerant gas in the stabilizer-vaporizer being in heat exchange relationship with vapour in the suction line passing from the evaporator through the stabilizer-vaporizer to the compressor.

5 Claims, 3 Drawing Sheets

REFRIGERATION SYSTEM WITH IMPROVED LIQUID SUB-COOLING

This invention relates to refrigeration systems.

BACKGROUND OF INVENTION

Conventional refrigeration systems have the compressor which pumps refrigerant vapour to a condenser where heat is expelled to cause a vapour to condense into liquid refrigerant. The liquid flows through a liquid line into a receiver tank, where sufficient liquid is stored to maintain a liquid seal for the liquid line through which the liquid refrigerant flows to a thermostatic expansion (TX) valve into an evaporator coil, where pressure is reduced to cause the liquid refrigerant to vaporize and absorb heat. The refrigerant vapour flows through a suction line to the compressor. This is a dynamic closed loop flow, with a change in state of the refrigerant from vapour to liquid emitting heat, then from liquid to vapour absorbing heat.

Before any cooling effect can be produced, the liquid refrigerant has to be cooled to the evaporating temperature. Thus, if the liquid refrigerant temperature is lowered (sub-cooled), less cooling energy is required.

Due to the negative impact on the environment caused by energy generation and the high cost of energy, it is of vital importance to reduce the consumption of electricity required to supply cooling for supermarkets and industry.

It is therefore an object of the invention to produce an improved energy efficient cooling system, with an efficient de-frost system, which functions as a liquid sub-cooler during the cooling cycle, and also protects the compressor from excess oil and liquid return.

It is therefore an object of the invention to provide an improved de-frosting cycle for a refrigerating system.

SUMMARY OF INVENTION

According to the invention, a refrigeration system has a compressor operable to supply relatively hot compressed refrigerant gas, a condenser to liquify the relatively hot compressed refrigerant gas from the compressor, a thermostatic expansion valve to vaporize liquified refrigerant from the condenser, an evaporator to cool the surrounding atmosphere to vaporize refrigerant from the thermostatic expansion valve, and a superheat sensor to improve control of the thermostatic expansion valve. A compressor discharge line conveys relatively hot compressed refrigerant gas from the compressor to the condenser, a liquid line conveys liquified refrigerant from the condenser to the expansion valve, and a suction line including the superheat sensor conveys vaporized refrigerant from the evaporator to the compressor. A liquid refrigerant stabilizer in the liquid line and the suction line conveys liquid refrigerant in the liquid line and vaporized refrigerant in the suction line in heat exchange relationship with each other to cause liquid refrigerant in the liquid line to be cooled by suction refrigerant in the suction line.

The present invention provides a de-frost valve assembly operable to effect defrosting by shutting off flow of liquid refrigerant from the condenser and substituting a flow of relatively hot compressed refrigerant gas from the compressor to cause the relatively hot compressed refrigerant gas to flow in the liquid line through the stabilizer to the thermostatic expansion valve and the evaporator to defrost the evaporator and return through the suction line through the stabilizer to the compressor. The stabilizer functions as a vaporizer during a de-frost cycle. With the relatively hot compressed refrigerant gas in the stabilizer-vaporizer being in heat exchange relationship with vapour in the suction line passing from the evaporator through the stabilizer-vaporizer to the compressor.

Advantageously, the thermostatic expansion valve with the superheat sensor has a capacity at least twice that of the evaporator. Also, the stabilizer is preferably constructed to cause the suction line vaporized refrigerant to have turbulent flow in heat exchange relationship with the liquid refrigerant in the liquid line, whereby the liquid refrigerant is influenced by the total mass of the suction line vaporized refrigerant.

Refrigeration systems having multiple evaporators, i.e. refrigerated display bases in a supermarket, could be split into a series of loops, each loop having two or more refrigerated fixtures with each fixture having an evaporator, a thermostatic expansion valve, and a superheat sensor connected to a common suction line, liquid line, hot gas line, a stabilizer-vaporizer and a valve arrangement to provide liquid sub-cooling or vaporizer defrost for the loop. Such multiple loops are connected in parallel to a common compressor unit, condenser and receiver.

DESCRIPTION OF THE DRAWINGS

One embodiment of the invention will now be described, by way of example, with reference to the accompanying drawings, of which.

DESCRIPTION OF PREFERRED EMBODIMENT

Figure 1:
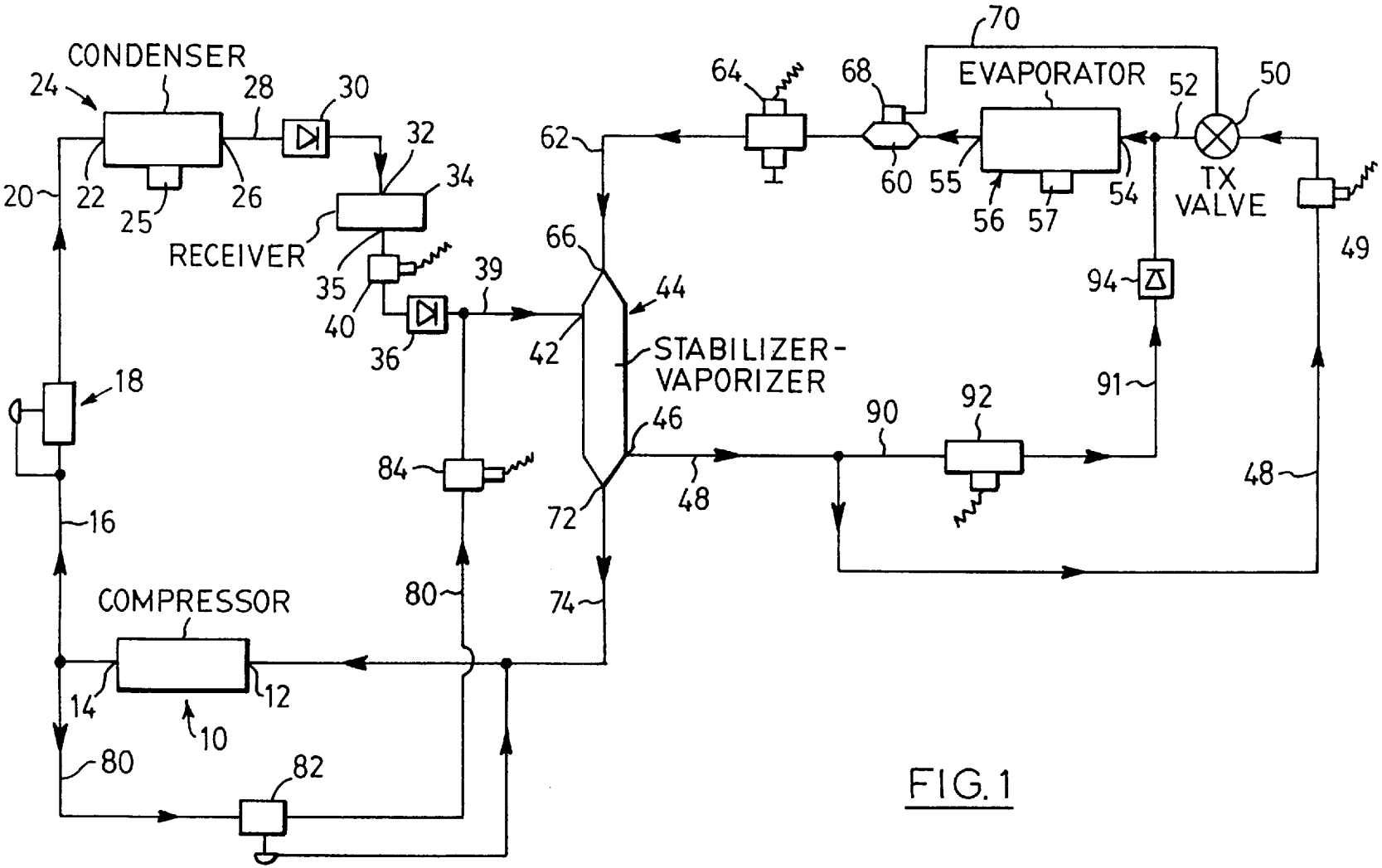
FIG. 1 is a schematic circuit diagram of a refrigeration loop system in accordance with one embodiment of the invention which has a single refrigeration load.

Referring to the drawings, FIG. 1 shows a refrigeration system with a compressor 10 having a suction inlet 12 and a high pressure hot gas outlet 14 with a gas discharge line 16 connected to the inlet of a pressure regulating valve 18. A gas discharge line 20 from the pressure regulating valve 18 is connected to the inlet 22 of a condenser coil 24. The outlet 26 of the condenser coil 24 is connected by liquid line 28 with a check valve 30 to the inlet 32 of a receiver 34. The outlet 36 of the receiver 34 is connected by liquid line 39 with an electrically-operated solenoid valve 40 to the inlet 42 of a stabilizer-vaporizer 44, which will be described in more detail later. The outlet 46 of the stabilizer-vaporizer 44 is connected by liquid line 48 to a thermostatic expansion (TX) valve 50, which is connected by liquid line 52 to the inlet 54 of an evaporator cooling coil 56. The TX valve 50 has a capacity at least twice that of the evaporator cooling coil 56.

The evaporator cooling coil 56 has a vapour outlet 55 connected to a superheat sensor 60 and then through suction line 62 with a normally open electrically-controlled pressure regulator 64 to the vapour inlet 66 of the stabilizer-vaporizer 44. The TX valve 50 has a temperature sensing bulb 68 attached to the superheat sensor 60 by a line 70 to improve control of the TX valve 50 in known manner. The stabilizer-vaporizer 44 has a vapour outlet 72 connected by a suction line 74 to the suction inlet 12 of compressor 10 to complete the cooling circuit.

During cooling, hot compressed gas from the compressor 10 is condensed in condenser coil 24, which has a fan 25 to pass cooling air over and through the finned heat exchange structure (not shown) of the condenser cooling coil 24. The resultant liquid refrigerant leaves the evaporator cooling coil 24 at outlet 26 and passes through the check valve 30 into the receiver 34. From the receiver 34, the liquid refrigerant passes through liquid line 39 and normally closed solenoid valve 40 into the inlet 42 of the stabilizer-vaporizer 44, exiting at outlet 46 into liquid line 48 for passage to the TX valve 50.

Liquid refrigerant from receiver 34 flows via liquid line 39, check valve 36 and open solenoid valve 40 into inlet 42 of the outer chamber of stabilizer-vaporizer 44, where it is cooled by the total mass of the cold suction gas flowing through the inner chambers. The cooled liquid refrigerant leaves the stabilizer-vaporizer via exit 46, into liquid line 48, then through the thermostatic expansion valve 50, which contains liquid flow into the evaporator 56 by means of sensing bulb 68 fastened to the superheat sensor 60. The vaporizing liquid refrigerant cools the adjacent space by air passed over the evaporator 56 by fan 57.

The resultant vapor then passes through the sensor 60 and non-functioning pressure regulator 64, via line 62, into inlet 66 of stabilizer-vaporizer 44, exiting at outlet 72 into suction line 74, to suction entrance 12 of compressor 10.

As is known in the art, the stabilizer-vaporizer 44 functions as a vaporizer during the defrost cycle. In accordance with the invention, the stabilizer-vaporizer 44 is utilized as a stabilizer during the cooling cycle. The hot gas discharge line 16 from the compressor 10 is also connected by hot gas line 80 with hot gas control 82 and solenoid valve 84 to the inlet 42 of stabilizer-vaporizer 44 via the relevant portion of liquid line 39. Also, liquid line 48 is connected through a hot gas line 90 with a solenoid valve 92 and check valve 94 to the inlet 54 of evaporator coil 56 through line 52.

When a defrost cycle is initiated (in any suitable manner which will be readily apparent to a person skilled in the art), solenoid valve 40 in liquid line 38 is closed to stop the flow of liquid refrigerant from the receiver 34, and solenoid 84 is opened to cause hot defrost gas to flow along line 80 from outlet 14 of the compressor 10 and along the relevant portion of liquid line 39 to the inlet 42 of stabilizer-vaporizer 44. The hot defrost gas flushes out liquid refrigerant from the stabilizer-vaporizer 44 and from the liquid line 48 and the TX valve 50. The flushed liquid refrigerant flows through the TX valve 50 and then passes into the evaporator coil 56 to evaporate with the fan 57 still operating, i.e. still effecting refrigeration.

After a predetermined time, the evaporator fan 57 is switched off and solenoid valve 92 is opened to cause hot defrost gas to flow along line 48 through line 90, line 91 and check valve 94 directly to the evaporator coil 56 and then through sensor 60 and stabilizer-vaporizer 44 to the compressor inlet 12. If pressure in vapour lines 62, 74 rises, control valve 82 throttles the hot gas flow in line 80 to maintain the desired suction pressure in suction line 74 in response to a signal therefrom.

Figure 3:
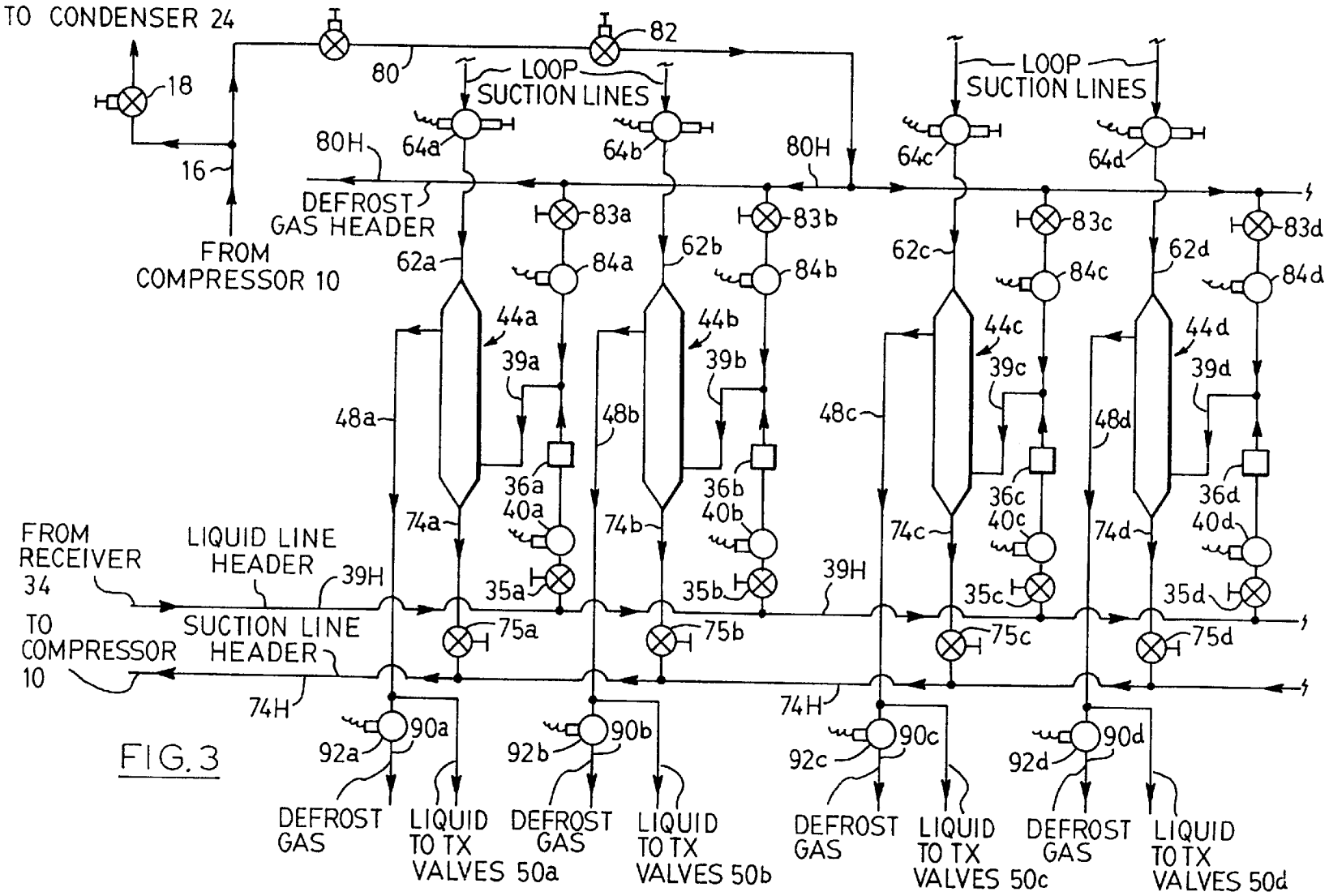
FIG. 3 is a schematic circuit diagram of a refrigeration system in accordance with another embodiment of the invention which has four refrigeration loops.

After a further predetermined time, which may be for example approximately 40% of the defrost time, the solenoid valve pressure regulator 64 is de-energized to render the pressure regulator 64 operative to regulate gas pressure in the evaporator coil 56, for example to about 40° F. saturation. This is especially useful, when (as will be described in more detail with reference to FIG. 3) a number of TX valves, evaporators are connected in parallel to ensure adequate defrosting of the evaporators, especially if they are not of equal size. The defrosting cycle is terminated in response to the temperature of the evaporator 56, again in a suitable manner which will be readily apparent to a person skilled in the art.

Figure 2:
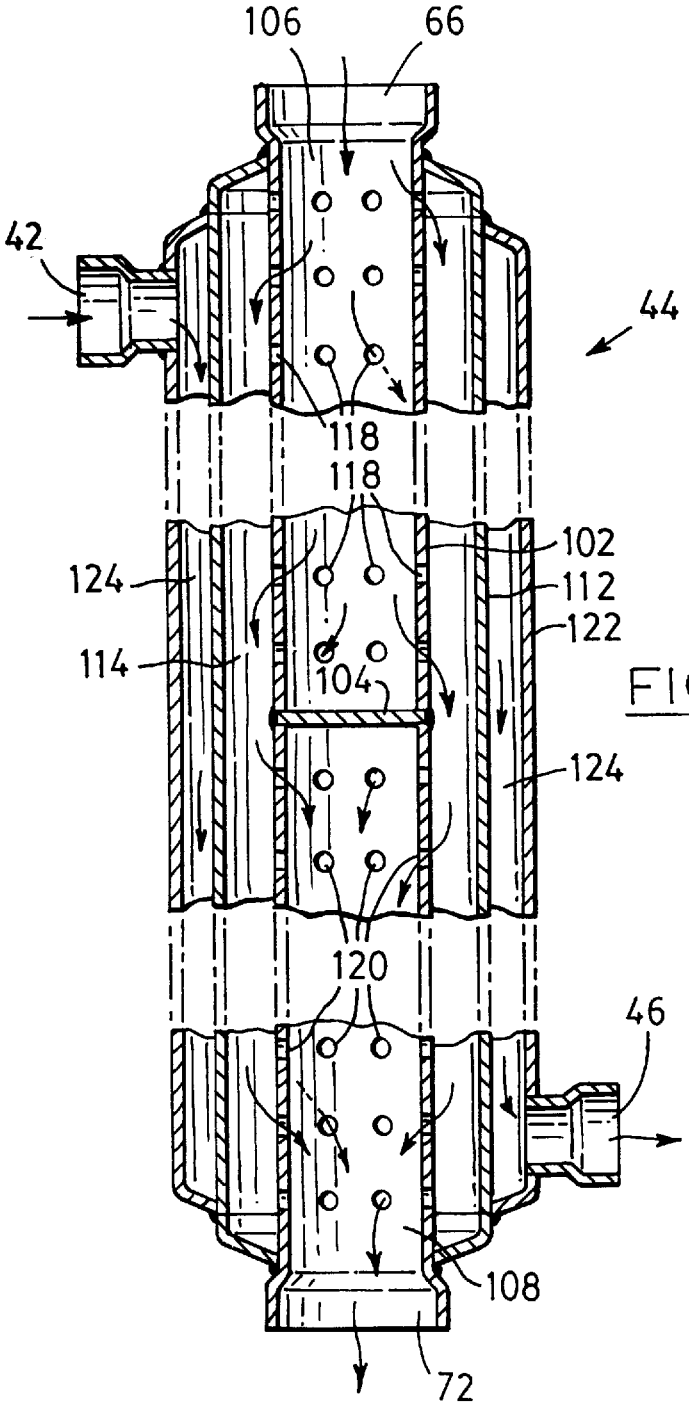
FIG. 2 is a longitudinal cross-sectional view of the stabilizer-vaporizer used in the circuit of FIG. 1.

The construction of the stabilizer-vaporizer 44 will now be described with reference to FIG. 2. The stabilizer-vaporizer 44 is made of metal, preferably high conductivity metal such as copper or brass, and has an inner cylindrical pipe 102 provided at the middle of its length with a transversely-extending circular disc 104 forming a barrier extending over the entire cross-sectional area of the pipe 102 and dividing the pipe interior into two separate cylindrical chambers 106, 108 which will be referred to for convenience of terminology as the first and third chambers. One end of the pipe 102 constitutes the inlet 66, while the other end constitutes the outlet 72.

The barrier disc 104 may be fastened into the interior of the pipe in any suitable manner or alternatively, as illustrated, it may be a connecting member between two co-axial pipe portions which together form the pipe 102. The barrier provided by disc 104 does not have to be absolutely gas tight between the first and the third chamber 106, 108. An intermediate cylindrical pipe 112 of larger diameter than the pipe 102 surrounds the first pipe 102 co-axially therewith and is sealed to the pipe 102 at both ends which are turned radially inwardly, thereby forming a second chamber 114 with an annular cross-section between the two pipes 102, 112.

Fast flowing refrigerant vapour entering the innermost pipe 102 through inlet 66 from the evaporator coil 56 impinges strongly against the transverse barrier 104 and immediately becomes extremely turbulent within the first chamber 106. The pipe 102 has a first series of apertures 118 distributed uniformly along the part of its length forming the first chamber 106, and also distributed uniformly around its periphery. The apertures 118 direct the turbulent refrigerant vapour from the chamber 106, together with any liquid therein, forcefully into the annular second chamber 114 and against the inner wall of the intermediate pipe 112.

The pipe 102 has another series of apertures 120 similarly uniformly distributed along the part of its length forming the second chamber 108 and around its periphery. The apertures 120 direct the highly turbulent vapour in the annular second chamber 114 into the third chamber 108 and out of the outlet 72. The abrupt change of direction of the vapour required for its passage through the second series of apertures 120 considerably increases its turbulence in the third chamber 108.

An outermost cylindrical pipe 122 co-axial with the pipes 102, 112, surrounds at least that portion of the intermediate pipe 112 adjacent the location of the apertures 118, 120, and has its ends radially inwardly turned and sealed to the pipe 112 so as to define an annular fourth chamber 124 surrounding the pipe 112. The inlet 42 is adjacent one end of the pipe 122 and the outlet 76 is adjacent the other end thereof, so that fluid passing into the stabilizer vaporizer 44 through the inlet 42 can be passed through the chamber 124 in heat exchange contact with as much as possible of the outer wall of the heat-conductive pipe 112. The fluid in chamber 124 is cooled by the pipe 112 against which the refrigerant vapour impinges after passing through apertures 118, and with which the resultant turbulent vapour remains in contact as it passes through the annular second chamber 114 toward the other set of apertures 120, resulting in complete and substantially immediate evaporation of any fine droplets in the turbulent vapour. The vapour in the chamber 114, now droplet-free, passes through the apertures 120 into the third chamber 108 and exits through outlet 72 to pass through suction line 74 to the compressor inlet 12.

The dimensions of the three pipes 102, 112, 122 and of the apertures 118, 120 relative to each other are important for optimum functioning of the stabilizer-vaporizer 44. The pipe 102 is preferably of at least the same internal diameter as the suction line 74 to the compressor 10, so that it is of the same cross-sectional flow area and capacity. The number and size of the apertures 118, 120 should be chosen so that the cross-sectional flow area provided by all the apertures is not less than about half of the cross-sectional area of the pipe 102, and preferably is about equal to or slightly larger than that area. The total cross-sectional area of the apertures 118, 120 need not be greater than about 1.5 time the cross-sectional area of the pipe 102, since increasing the ratio beyond this value has very little corresponding increased beneficial effect, if any. Moreover, each individual aperture 118, 120 should not be too large. If a larger flow area is required, it is preferable to provide this by increasing the number of apertures.

As described above, the purpose of the apertures 118 is to direct the flow of refrigerant vapour radially outwardly into impingement contact with the inner wall of the pipe 112, and this purpose may not be sufficiently achieved if the apertures 118 are too large. The apertures 118 should be uniformly distributed along and around the respective portion of the pipe 102 to maximize the area of the adjacent portion of the wall of pipe 112 that is contacted by the vapour issuing from the apertures 118. Thus, the fluid in chamber 124 is influenced by the total mass of the suction line vaporized refrigerant.

It is also important that the cross-sectional flow area of the second annular chamber 114 be not less than about half of the corresponding flow area of the pipe 102. Again, the areas are preferably approximately equal, with the possibility of the area of annular chamber 114 being slightly greater than that of pipe 102, the preferred maximum ratio again being about 1.5. The diameter of the pipe 122 should be sufficiently greater than that of the pipe 112 so that the cross-sectional flow area of the annular chamber 124 is not less than that of line 30 to the stabilizer-vaporizer inlet 42. The cross-sectional flow area of the annular chamber 124 may be up to about 1.5 times larger than that of return line 39. The inlet 42 to the chamber 124 and the outlet 128 therefrom should of course be of sufficient size so as not to throttle the flow of fluid therethrough.

It will be understood by those skilled in the art that, when the stabilizer-vaporizer 44 is constructed in this manner, it will appear to the remainder of the system during normal cooling operation as nothing more than another portion of the suction line 74, or at most a minor constriction or expansion thereof with insufficient change in flow capacity to vary the characteristics of the system significantly. The system can therefore be designed without regard to this particular flow characteristic of the stabilizer-vaporizer 44. It will also be noted that the stabilizer-vaporizer 44 can be incorporated by retrofitting into the piping of an existing refrigeration system without causing any unacceptable changes in the flow characteristics of the system.

As previously mentioned, the stabilizer-vaporizer 44 functions as a vaporizer during the defrost cycle. The defrost gas warms the evaporator coil 56 using sensible and latent heat, and consequently becomes a mixture of liquid and superheated vapour. As this mixture passes through the sensor 60, the superheated vapour is brought into close contact with the liquid component and vaporizers part of the liquid component. This resultant saturated mixture passes into the first chamber 106 of the stabilizer-vaporizer 44 wherein it is stopped by the central barrier 104 and then sprayed through the apertures 118 to strike the hot inner wall of the pipe 112 which is heated by the hot defrost gas in the fourth chamber 124. The heated fluid then flows through the apertures 120 into the second chamber 108 and then to the compressor inlet 12.

Thus, the present invention provides a single component with no moving parts and hence no maintenance requirement which functions as a stabilizer during cooling and as a vaporizer during defrost with resultant improved economics and higher operating efficiency.

It will be noted that the heat content of the liquid refrigerant has to be removed to lower its temperature to the operating saturated temperature. This is part of the system load. Also, with environmentally safe refrigerants which now have to be used, synthetic lubricating oils must be used. Such oils are known to build up in the evaporator and entrap liquid refrigerant, resulting the oil globs containing liquid refrigerant causing compressor failure, especially when two stage compressors are used. The present invention sub-cools the liquid refrigerant and adds heat to the return suction gas thereby vaporising any liquid present thereby reducing the likelihood of refrigerant laden synthetic oil returning erratically with the return suction refrigerant gas to the compressor.

From the foregoing description, it will be apparent that the present invention increases efficiency and also reduces power consumption by utilizing energy which would normally be wasted as heat rejected by the condenser.

The refrigeration system described with reference to FIG. 1 has a single evaporator/TX valve loop. As mentioned earlier, the present invention is especially useful with a refrigeration system which has a number of such refrigeration loops with multiple evaporators, as for example in a supermarket. A refrigeration system with four refrigeration loops will now be described with reference to FIG. 3.

Four refrigeration loops have a common compressor 10, a common condenser 24, and a common receiver 34 and are connected in parallel therewith. For ease of explanation, the same reference numerals used in FIG. 1 will be used in FIG. 3 and, where components shown in FIG. 1 are present in each loop in FIG. 3, such components will be indicated with a reference numeral used in FIG. 1 followed by a, b, c, or d, as appropriate.

Liquid refrigerant from the receiver 34 passes through a liquid header line 39H and then passes through manually-operated shut-off valves 35*a*, 35*b*, 35*c*, 35*d*, in each loop to electrically-operated shut-off valves 40*a*, 40*b*, 40*c*, 40*d* respectively and then through check valves 36*a*, 36*b*, 36*c*, 36*d*. Hot gas from compressor 10 passes into defrost gas header line 80H, and then passes through manually-operated shut-off valves 83*a*, 83*b*, 83*c*, 83*d* in each loop to electrically-operated solenoid valves 84*a*, 84*b*, 84*c*, 84*d* respectively.

The following description will relate to the first loop, and it will be understood that such description also applies to the second, third and fourth loops. During a refrigeration cycle, manually-operated valve 35*a* and electrical-operated valve 40*a* are open, and liquid refrigeration passes from the liquid header line 39H through line 39*a* and check valve 36*a* to the stabilizer-vaporizer 44*a*, and then from the stabilizer-vaporizer 44*a* through line 48*a* to the tx valve and evaporator coils (not shown) of the first loop. A refrigerant vapour leaving the evaporator coil passes through a superheat sensor (also not shown) and electrically-operated valve 64*a* to the stabilizer-vaporizer 44*a* and then through suction line 74*a* and a manually-operable shut-off 75*a* to suction line header 74H which returns the vaporized refrigerant to the compressor 10.

During a defrost cycle, electrically-operated solenoid valve 40*a* is closed and electrically-operated solenoid valve 84 is opened so that hot defrost gas passes from the hot gas header 80H through manually-operated valve 83*a* and electrically-operated valve 84*a,* and line 39*a* to the stabilizer-vaporizer 44*a* and then through line 48*a* to the tx valve of the first loop. After a pre-determined time, as previously described, electrically-operated solenoid valve 92 is opened so that hot defrost gas passes along 90*a* to the evaporator. After passing through the evaporator coils, the defrost gas returns through stabilizer-vaporizer 44*a,* line 74*a* and manually-operated valve 75*a* to the suction line header 74H. As also previously described, pressure regulator 64*a* is actuated after a pre-determined time to regulate gas pressure in the evaporator coils of the first loop. Such regulation takes place in all the loops and ensures adequate de-frosting of the evaporator coils in each loop, even if the evaporator coils in the various loops are not of equal size.

Other embodiments of the invention will be readily apparent to a person skilled in the art, the scope of the invention being defined in the appended claims.

I claim:

1. A refrigeration system having a compressor operable to supply relatively hot compressed refrigerant gas, a condenser to liquify the relatively hot compressed refrigerant gas from the compressor, a thermostatic expansion valve to vaporize liquified refrigerant from the condenser, an evaporator to cool the surrounding atmosphere by vaporized refrigerant from the thermostatic expansion valve, a superheat sensor to improve control of the thermostatic expansion valve, a compressor discharge line to convey relatively hot compressed refrigerant gas from the compressor to the condenser, a liquid line to convey liquified refrigerant from the condenser to the expansion valve, a suction line including said superheat sensor to convey vaporized refrigerant from the evaporator to the compressor, a liquid refrigerant stabilizer in said liquid line and said suction line operable to convey liquid refrigerant in said liquid line and vaporized refrigerant in said suction line in heat exchange relationship with each other to cause liquid refrigerant in said liquid line to be cooled by suction refrigerant in said suction line, and a de-frost valve assembly operable to effect de-frosting by shutting off flow of liquid refrigerant from the condenser and substituting a flow of relatively hot compressed refrigerant gas from the compressor to cause the relatively hot compressed refrigerant gas to flow in the liquid line through the stabilizer to the thermostatic expansion valve and the evaporator to defrost the evaporator and return through the suction line through the stabilizer to the compressor, whereby the stabilizer functions as a vaporizer during a de-frost cycle with the relatively hot compressed refrigerant gas in the stabilizer-vaporizer being in heat exchange relationship with vapour in the suction line passing from the evaporator through the stabilizer-vaporizer to the compressor.

2. A refrigeration system according to claim 1 wherein the thermostatic expansion valve with said superheat sensor has a capacity at least twice that of the evaporator.

3. A refrigeration system according to claim 1 wherein the stabilizer is constructed to cause the suction line vaporized refrigerant to have turbulent flow during heat exchange relationship with the liquid refrigerant in the liquid line, whereby the liquid refrigerant is influenced by the total mass of the suction line vaporized refrigerant.

4. A refrigeration system according to claim 3 wherein the stabilizer comprises an inner cylindrical pipe with a transverse barrier at the middle of its length forming first and second chambers on opposite sides thereof, the inner pipe having an inlet at one end receiving refrigerant vapour from the evaporator and an outlet at the other end from which refrigerant vapour flows to the compressor, an intermediate cylindrical pipe surrounding the first pipe and sealed thereto at both ends to form a third chamber between the intermediate and inner pipes, the inner pipe having a first series of apertures in the first chamber and another series of apertures in the second chamber, and an outer cylindrical pipe surrounding the intermediate pipe and sealed thereto at opposite ends to form a fourth chamber, the fourth chamber having an inlet receiving refrigerant liquid from the condenser and an outlet from which refrigerant liquid flows to the thermal expansion valve, whereby refrigerant vapour together with any liquid entrained therein from the evaporator in the first chamber impinges against the transverse barrier and passes turbulently through the first series of apertures into the third chamber and against the intermediate pipe to effect heat exchange with refrigerant liquid in the fourth chamber and then pass through the second series of apertures into the second chamber and then to the compressor.

5. A refrigeration system according to claim 1 having a series of refrigeration loops, each loop including multiple thermostatic expansion valves, evaporators, superheat sensors, a stabilizer-vaporizer providing liquid sub-cooling and de-frost capability, the refrigeration loops having a common compressor, a common condenser and a common receiver and being connected in parallel therewith.

* * * * *